US009254414B2

(12) United States Patent
Liu et al.

(10) Patent No.: US 9,254,414 B2
(45) Date of Patent: Feb. 9, 2016

(54) EXERCISE DEVICE

(71) Applicant: Dyaco International Inc., Taipei (TW)

(72) Inventors: Shih-Wei Liu, Taipei (TW); Hsuan-Fu Huang, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 140 days.

(21) Appl. No.: 14/225,903

(22) Filed: Mar. 26, 2014

(65) Prior Publication Data

US 2015/0087481 A1 Mar. 26, 2015

(30) Foreign Application Priority Data

Sep. 24, 2013 (TW) ..... 102134387 A

(51) Int. Cl.

| | |
|---|---|
| ***A63B 22/04*** | (2006.01) |
| ***A63B 22/06*** | (2006.01) |
| ***A63B 22/12*** | (2006.01) |
| ***A63B 69/16*** | (2006.01) |
| ***A63B 23/035*** | (2006.01) |
| ***A63B 22/00*** | (2006.01) |
| ***A63B 22/20*** | (2006.01) |
| *A63B 21/005* | (2006.01) |
| *A63B 21/012* | (2006.01) |
| *A63B 21/22* | (2006.01) |
| *A63B 71/00* | (2006.01) |

(52) U.S. Cl.

CPC ..... *A63B 22/0664* (2013.01); *A63B 22/001* (2013.01); *A63B 22/0015* (2013.01); *A63B 22/208* (2013.01); *A63B 23/03583* (2013.01); *A63B 23/03591* (2013.01); *A63B 21/005* (2013.01); *A63B 21/012* (2013.01); *A63B 21/225* (2013.01); *A63B 2022/002* (2013.01); *A63B 2022/0676* (2013.01); *A63B 2022/0682* (2013.01); *A63B 2071/009* (2013.01)

(58) Field of Classification Search

CPC ..... A63B 21/225; A63B 22/001; A63B 22/0015; A63B 22/0048; A63B 22/0056; A63B 22/0664; A63B 22/201; A63B 22/208; A63B 2022/0676; A63B 2022/0682

See application file for complete search history.

(56) References Cited

U.S. PATENT DOCUMENTS 7,618,350 B2 * 11/2009 Dalebout ..... A63B 22/001 428/52
8,734,298 B2 * 5/2014 Murray ..... A63B 22/001 482/51

(Continued)

FOREIGN PATENT DOCUMENTS

CN 202538249 11/2012
CN 103301603 9/2013

OTHER PUBLICATIONS

"International Search Report", Aug. 13, 2014.

*Primary Examiner* — Oren Ginsberg
(74) *Attorney, Agent, or Firm* — WPAT, PC; Justin King

(57) ABSTRACT

An elliptical trainer comprises a reciprocal-movement mechanism and an angle-adjusting chassis. The angle-adjusting chassis comprises a frame, a guider, an angle-adjusting assembly, and an intermediary part. Both the front end of the frame and the rear end of the guider may contact a supporting surface, and the rear portion of the frame may be pivotally coupled with a front portion of the guider. The angle-adjusting assembly is arranged near the rear portion of the frame, and the intermediary part is arranged at or near or attached to the front portion of the guider. The angle-adjusting assembly pushes the intermediary part, such that the guider rotates around its rear end, and the frame rotates around its front end, resulting in varying a first angle between the guider and the supporting surface and varying a second angle between the frame and the supporting surface.

27 Claims, 13 Drawing Sheets

(56) References Cited

U.S. PATENT DOCUMENTS 8,979,713 B2 * 3/2015 Huang ..... A63B 22/04 482/51

2007/0060450 A1 * 3/2007 Lo ..... A63B 22/001 482/52

2012/0322624 A1 12/2012 Wu

* cited by examiner

EXERCISE DEVICE

CROSS-REFERENCE TO RELATED APPLICATIONS

The entire contents of Taiwan Patent Application No. 102134387, filed on Sep. 24, 2013, from which this application claims priority, are incorporated herein by reference.

BACKGROUND OF THE INVENTION

1. Field

The embodiments of the invention relate to exercise devices or machines, and more particularly relates to elliptical exercise machines having angle-adjusting mechanisms.

2. Description of Related Art

Without limiting the disclosed embodiments, an elliptical trainer, also called a cross-trainer or an X-trainer, is a stationary exercise machine to simulate stair climbing, walking, or running.

The elliptical trainer does not cause excessive pressure to the joints as the two legs simultaneously share the burden, hence decreasing the risk of impact injuries.

The elliptical trainer typically includes two pedals capable of being stepped by a user. For conventional elliptical trainers, the track of the pedals cannot be varied.

Taiwan Patent, Publication No., M403355, entitled "Rising Device for Elliptical Trainers," discloses an elliptical trainer with a rising device that can adjust the track of the pedals. As shown in FIG. 1, the rising device 40 comprises a motor assembly 403 including a motor 4031, a screw 4032, and a thread tube 4033. The motor 4031 can drive the screw 4032 to rotate and to make the thread tube 4033 moving in the direction away from the motor 4031. The stick 4051 of the rising device 405 is pushed by the thread tube 4033, causing the wheel 413 sliding on the ground and the guider 402 above the frame 401 rotating about two ear parts 4021. An angle is therefore present between the guider 402 and the frame 401, and the tracks of the pedals are thus varied. The entire contents of above-mentioned Taiwan Patent are incorporated herein by reference.

Yet there is still a need for an elliptical trainer that can reduce cost and increase stability and varieties of exercise.

SUMMARY OF THE INVENTION

In one general aspect, the present invention relates to exercise devices or machines, and more particularly relates to exercise devices or machines having the angle-adjusting mechanism.

In an embodiment of the present invention, an elliptical trainer is provided with an angle-adjusting chassis and a reciprocal-movement mechanism. The reciprocal-movement mechanism is operable between at least a first position and a second position. The reciprocal-movement mechanism has a front portion and a rear portion. The angle-adjusting chassis couples with the reciprocal-movement mechanism and configured to change a moving path of the reciprocal-movement mechanism. A frame couples with the front portion of the reciprocal-movement mechanism. The frame has a rear portion and a front portion configured to be supported by a supporting surface. The angle-adjusting chassis is configured to change the moving path of the reciprocal-movement mechanism by varying a degree of the front portion of the frame relative to the supporting surface. A guider is movably coupled with the rear portion of the reciprocal-movement mechanism. The guider has a front portion pivotably coupled with the rear portion of the frame and a rear portion supported by the supporting surface. An angle-adjusting assembly couples with the frame for driving an intermediary part that causes the rear portion of the frame to rise or fall between a first level and a second level, a movement of the rear portion of the frame causing an incline angle of the guider to vary between a first guider incline angle and a second guider incline angle.

In another embodiment of the present invention, an exercise device is provided with an angle-adjusting chassis and a reciprocal-movement mechanism capable of being operated by a user. The angle-adjusting chassis comprises a frame, a guider, an intermediary part, an angle-adjusting assembly. The reciprocal-movement mechanism is arranged on the frame. A front portion of the frame is configured to be supported by a supporting surface. A rear portion of the frame movably couples with a front portion of the guider, and a rear portion of the guider is configured to be supported by the supporting surface. The angle-adjusting chassis is configured to change at least one moving path of the reciprocal-movement mechanism by varying a degree of the front portion of the frame relative to the supporting surface. The angle-adjusting assembly couples with the frame for driving a movement of the front portion of the frame to vary the degree of the front portion of the frame relative to the supporting surface.

In another embodiment of the present invention, an elliptical trainer is provided with an angle-adjusting chassis and a reciprocal-movement mechanism capable of being operated by a user. The angle-adjusting chassis comprises a frame, a guider, an intermediary part, an angle-adjusting assembly, and a linkage assembly. The reciprocal-movement mechanism is arranged on the frame, a front end of the frame contacting with a supporting surface. A rear portion of the frame pivotally couples with a front portion of the guider, and a rear end of the guider contacts with the supporting surface. The intermediary part fixes with the guider. The linkage assembly comprises an upper end, a middle pivot, and a lower end, wherein the upper end pivotally connects with the angle-adjusting assembly, the middle pivot pivotally connects with intermediary part, and the lower end is in contact with the supporting surface. When the angle-adjusting assembly pushes the linkage assembly, the guider rotates clockwise around a pivot point near its rear end, and the frame rotates counterclockwise around a pivot point near its front end, resulting in a variation in each of a first angle between the frame and the supporting surface, a second angle between the guider and the supporting surface, and a third angle between the linkage assembly and the supporting surface.

In an embodiment, the reciprocal-movement mechanism comprises a flywheel providing a damping effect, a driving wheel for driving the flywheel, two cranks respectively arranged at a side of the driving wheel for driving the driving wheel, two supporting driving arms with each arm comprising two ends in which one end couples with one of the two cranks and the other end movably couples with the guider.

In an embodiment, the reciprocal-movement mechanism further comprises two handle members, two handle members, two linkage arms, and two pedals. The two handle members movably couples to the angle-adjusting chassis, each of the two handle members having at least one upper end for enabling a user operation by hand. Each linkage arm couples between a lower end of one of the two handle members and a portion one of the two driving arms. The two pedals couples with the linkage arms.

In an embodiment, each of the two pedals is pivotally or adjustably coupled with a corresponding linkage arm of the two linkage arms.

In an embodiment, the reciprocal-movement mechanism provides an elliptical or elliptical-like moving path between the first position and the second position and enables an operation by foot movements.

In an embodiment, the frame is pivotably movable relative to the supporting surface based on a pivot point near the front portion of the frame and near the supporting surface.

In an embodiment, the guider is pivotably movable relative to the supporting surface based on a pivot point near the rear portion of the guider and near the supporting surface.

In an embodiment, at least the front portion of the frame and the rear portion of the guider provide ground support for supporting the exercise device when the exercise device rests on the supporting surface.

In an embodiment, the guider rotates clockwise around a pivot point near the rear portion of the guider to increase the incline angle when the frame rotates counterclockwise around a pivot point near the front portion of the frame, resulting in a first frame incline angle between a bottom of the frame and the supporting surface and the incline angle between the first guider incline angle and the second guider incline angle, with the incline angle being between a bottom of the guider and the supporting surface.

In an embodiment, a rear end of the frame is pivotally attached to and below the front end of the guider.

In an embodiment, the angle-adjusting assembly is attached to the rear portion of the frame.

In an embodiment, the intermediary part is placed near and substantially under a front end of the guider.

DETAILED DESCRIPTION OF THE PREFERRED EMBODIMENT

Figure 1:
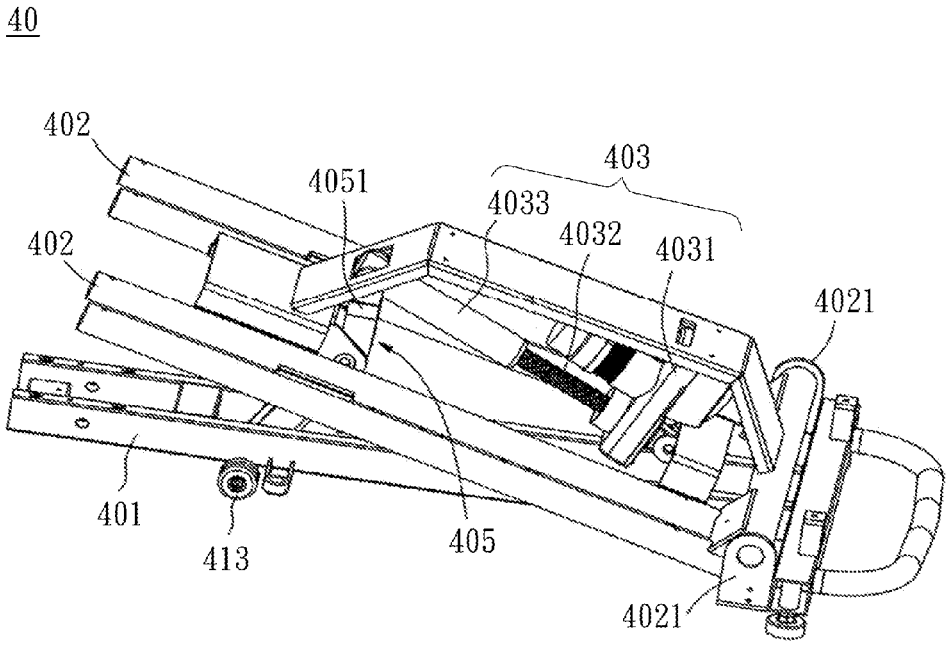
FIG.1(Prior Art)
FIG. 1 is a front view showing a conventional rising device for an elliptical trainer.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2A:
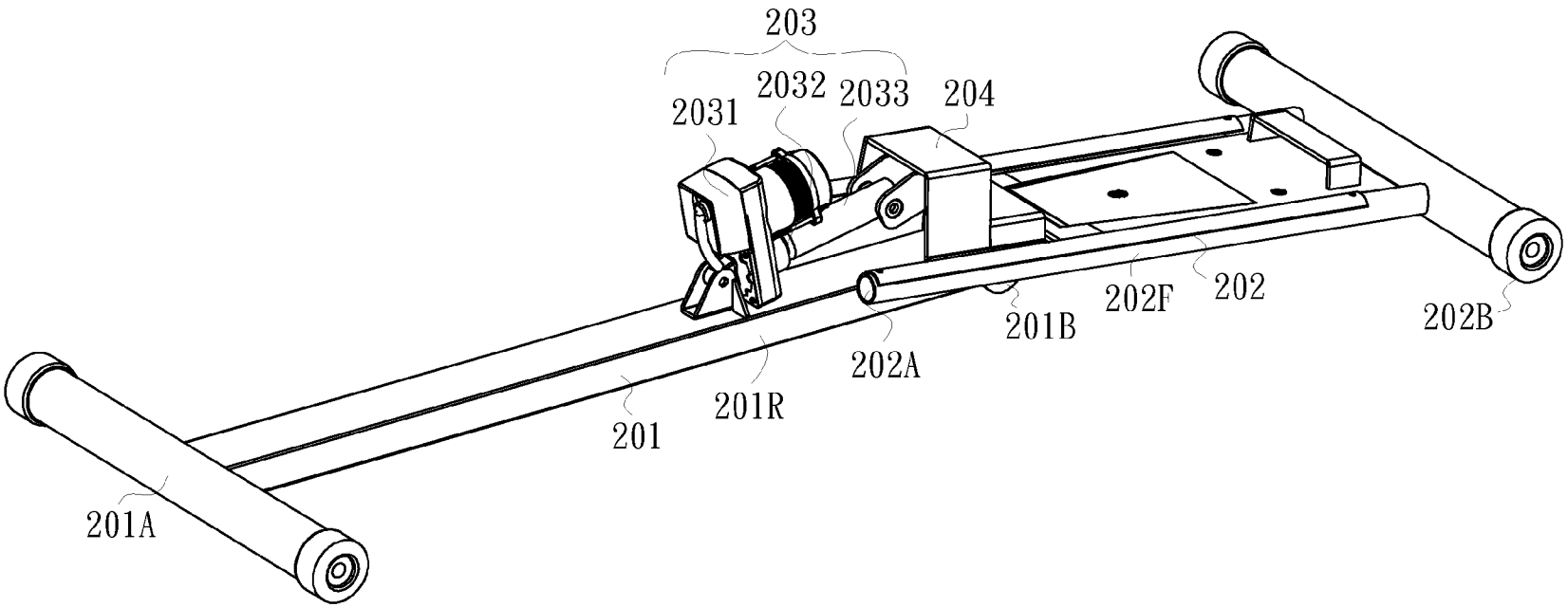
FIGS. 2A and 2B are front views showing an angle-adjusting chassis according to a first embodiment of the present invention.
Figure 2B:
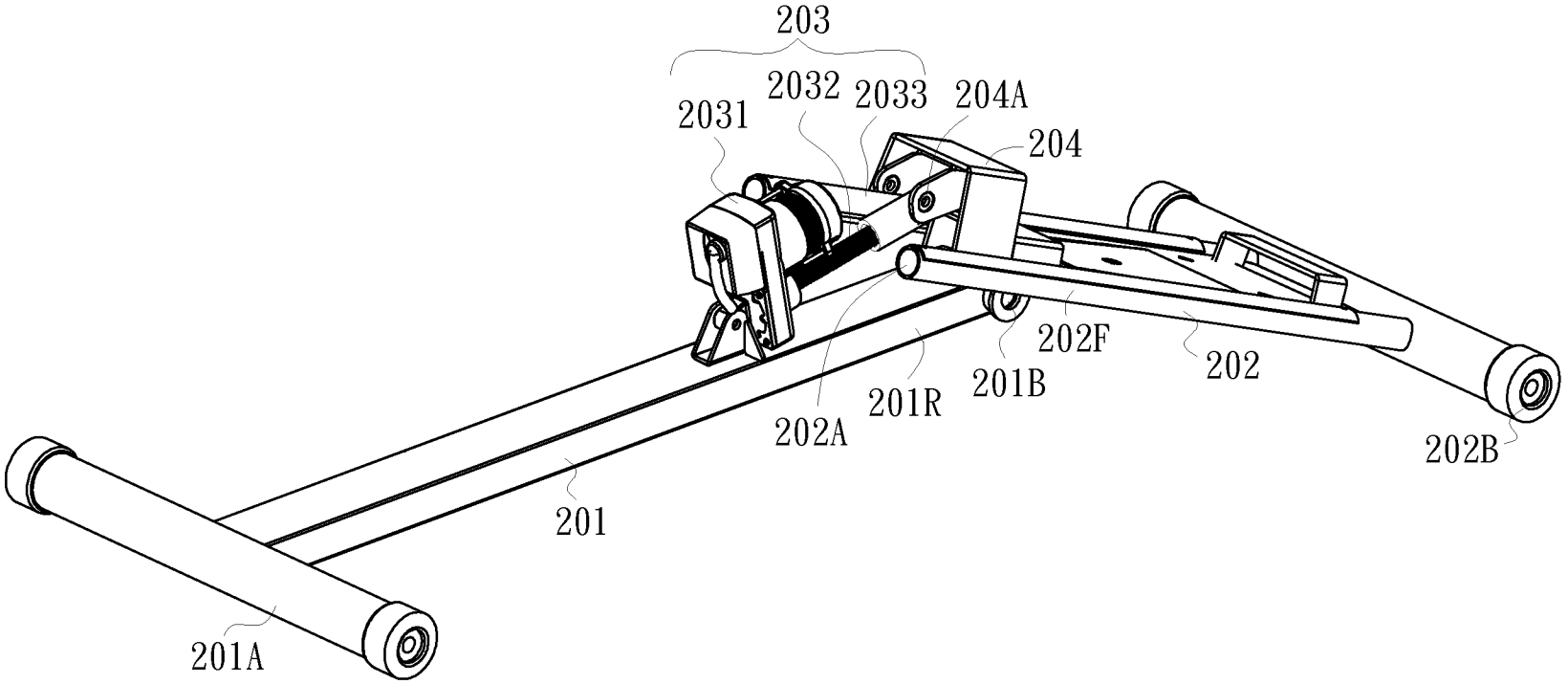

Referring to FIGS. 2A and 2B, an angle-adjusting chassis 20 is disclosed according to a first embodiment of the present invention, in which FIG. 2A shows the angle-adjusting chassis 20 at a first position, and FIG. 2B shows the angle-adjusting chassis 20 at a second position.

As shown in FIGS. 2A and 2B, the angle-adjusting chassis 20 comprises a frame 201, a guider 202, an angle-adjusting assembly 203, and an intermediary part 204. Preferably, the front end 201A or the front portion 201F of the frame 201 may have a wheel or pivot contacting with a supporting surface, and the rear end 202B or the rear portion 202R of the guider 202 may have a wheel or pivot contacting with the supporting surface. The supporting surface is preferably, but is not limited to, the ground.

The rear portion 201R of the frame 201 pivotally couples with the front portion 202F of the guider 202; the connection can be the horizontally connected or connected above or below the guider 202. In this context, the term "the rear portion 201R of the frame 201" refers to the rear end 201B of the frame 201 and the portion near the rear end 201B, and the term "the front portion 202F of the guider 202" refers to the front end 202A of the guider 202 and the portion near the front end 202A.

In this preferred embodiment, the rear end 201B of the frame 201 pivotally attached to and below the guider 202 and near the front end 202A of the guider 202. In another embodiment, the rear end 201B of the frame 201 pivotally connects with the front end 202A of the guider 202.

In this embodiment, the intermediary part 204 fixed with the guider 201, and the angle-adjusting assembly 203 fixes with the frame 201 for driving (ex., pushing or drawing) the intermediary part 204 that cause the front portion of the guider 202 to rise or fall between a first level and a second level, wherein a movement of the front portion of the guider causes an incline angle of the guider to vary between a first guider incline angle and a second guider incline angle. In this embodiment, the angle-adjusting assembly 203 may comprise, but is not limited to, a motor 2031, a screw 2032, and a thread tube 2033. In addition, the intermediary part 24 may pivotally connect with thread tube 2033 via a pivot 204A.

FIG. 2A shows the frame 201 and the guider 202 at the first position. As shown in FIG. 2B, the angle-adjusting assembly 203 can push the intermediary part 204 to make the frame 201 and the guider 202 at the second position.

In detail, the motor 2031 can drive the screw 2032 to rotate and to thus make the thread tube 2033 moving in the direction away from the motor 2031, so as to push the intermediary part 204. When the angle-adjusting assembly 203 pushes the intermediary part 204, the guider 202 rotates clockwise around at a pivot point near to its rear end 202B, and the frame 201 rotates counterclockwise around a pivot point near to its front end 201A. As a result, a first θ1 is present between the guider 202 and the supporting surface (e.g., the ground), and a second angle θ2 is present between the frame 201 and the supporting surface.

The intermediary part 204 may be attached above the guider 202 and near the front end 202A of the guider, and the angle-adjusting assembly 203 may be attached to or above the frame 201 and near the rear end 201B of the frame. The same or similar purpose can be achieved when one or two of the above-mentioned components are arranged at other locations. For example, the intermediary part 204 can be coupled at the front end 202A of the guider, or attached near to and substantially under a front end 202A of the guider 202. For example, the angle-adjusting assembly 203 could not be fixed with the frame 201 but fixed with other mechanism for providing a force pushing the intermediary part 204. In an embodiment, a rear end of the frame is pivotally mounted attached to and below the front end of the guider. In an embodiment, the angle-adjusting assembly is attached to the rear portion of the frame. In an embodiment, the intermediary part is placed near and substantially under a front end of the guider. Modification, equivalent, and exchange can be made to the present invention for a person skilled in the art, and those modification, equivalent, and exchange are within the scope of the present invention.

Figure 3:
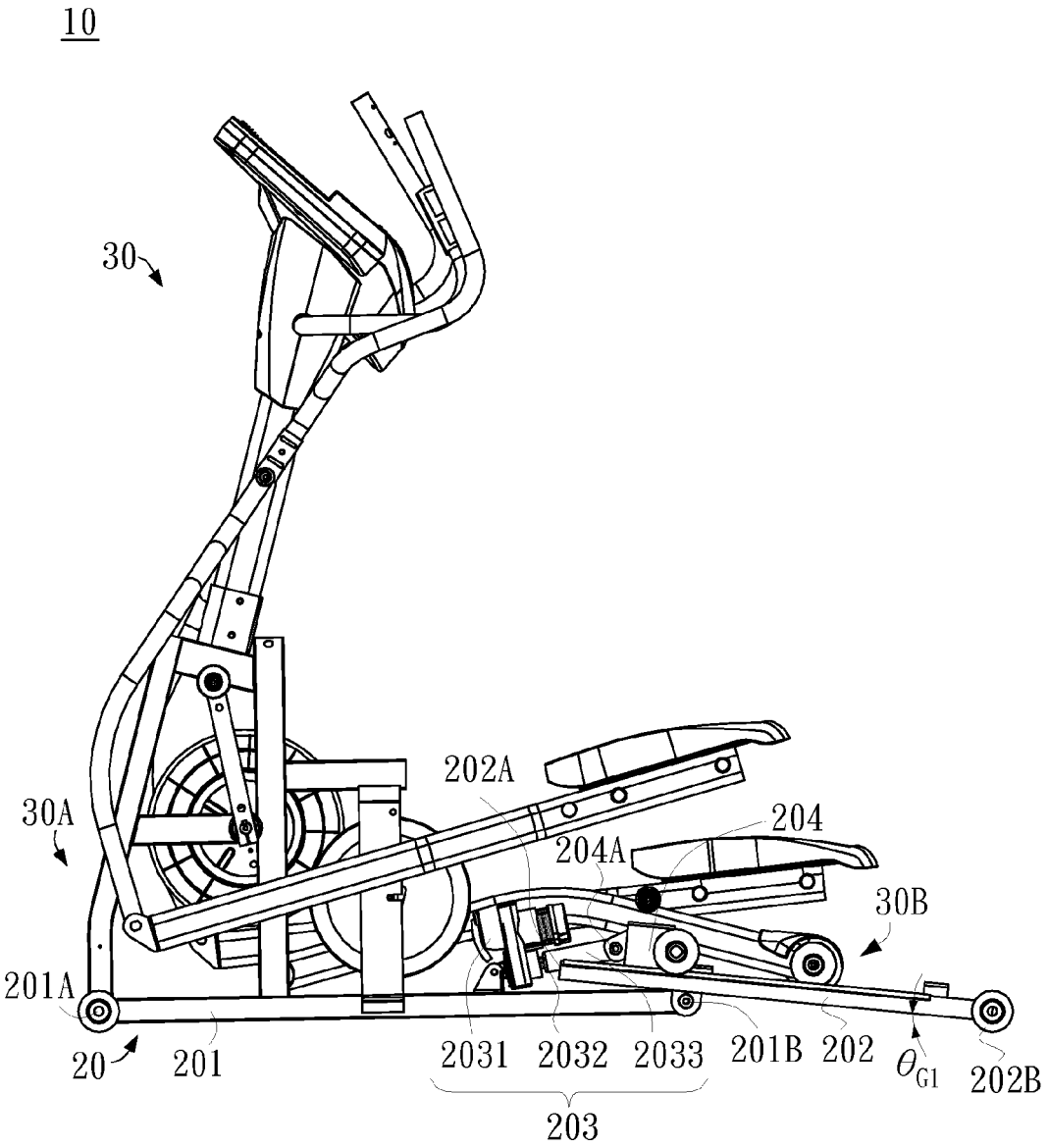
FIGS. 3, 4, and 5 are side and front views showing an exercise device according to a first embodiment of the present invention.
Figure 4:
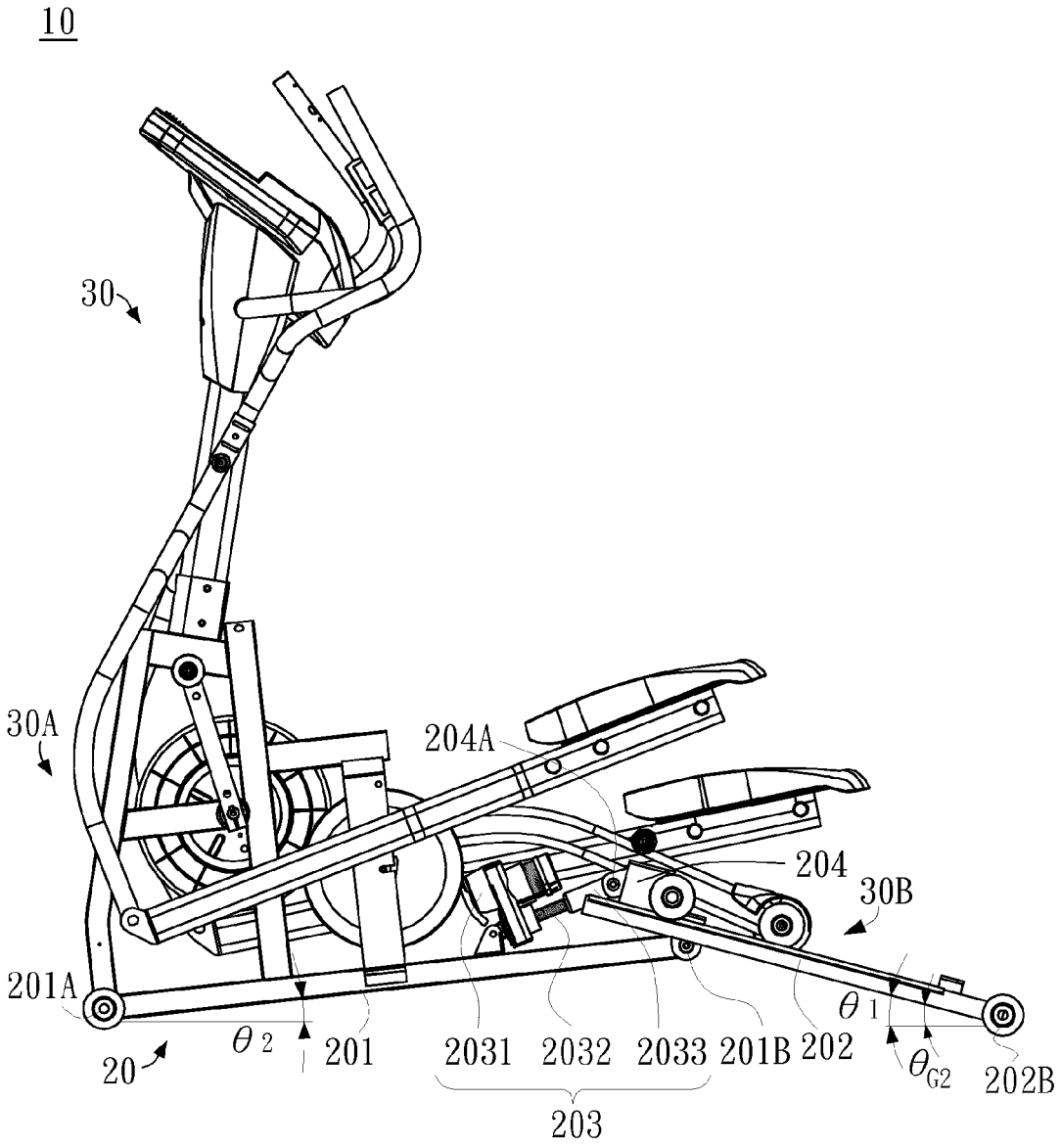

FIGS. 3, 4, 5, and 6 show an exercise device 10 according to a first embodiment of the present invention. As shown in FIG. 3, the elliptical trainer 10 comprises the above-mentioned angle-adjusting chassis 20 and a reciprocal-movement mechanism 30. The reciprocal-movement mechanism 30 can be operated by a user, e.g., operable for simulating stair climbing, walking, or running. The reciprocal-movement mechanism 30 has a front portion 30A and a rear portion 30B. The frame 201 couples with the front portion 30A of the reciprocal-movement mechanism 30. The guider 202 movably couples with the rear portion 30B of the reciprocal-movement mechanism 30. The angle-adjusting chassis 20 comprises the frame 201, the guider 202, the angle-adjusting assembly 203, and the intermediary part 204. The reciprocal-movement mechanism 30 is mainly arranged on the frame 201. FIG. 3 shows reciprocal-movement mechanism 30, the frame 201, and the guider 202 of the elliptical trainer 1 at a first position. FIG. 4 shows reciprocal-movement mechanism 30, the frame 201, and the guider 202 of the elliptical trainer 1 at a second position. The angle-adjusting chassis 20 is configured to change at least one of a moving path of the reciprocal-movement mechanism 30, the first position, and the second position. The angle-adjusting chassis 20 is configured to change the moving path of the reciprocal-movement mechanism by varying a degree of the front portion of the frame relative to the supporting surface.

In one embodiment, the frame 201 is pivotably movable relative to the supporting surface based on a pivot point near the front portion of the frame 201 and near the supporting surface. In one embodiment, the guider 202 is pivotably movable relative to the supporting surface based on a pivot point near the rear portion of the guider and near the supporting surface.

As shown in FIG. 4, the angle-adjusting assembly 203 is a motor assembly comprising a motor 2031, a screw 2032, and a thread tube 2033 according to this embodiment. The motor 2031 can drive the screw 2032 to rotate and to thus make the thread tube 2033 moving in the direction away from the motor 2031, so as to push the intermediary part 204. When the angle-adjusting assembly 203 pushes the intermediary part 204, the guider 202 rotates clockwise around its rear end 202B, and the frame 201 rotates counterclockwise around its front end 201A. As a result, a first angle θ1 (guider incline angle) is present between the guider 202 and the supporting surface (e.g., the ground), and a second angle θ2 (frame incline angle) is present between the frame 201 and the supporting surface. The first angle θ1 is an angle of the front portion of the frame relative to the supporting surface or ground. Referring to FIGS. 3 and 34, the angle-adjusting assembly 203 drives the intermediary part 204 that cause the front portion of the guider 202 and/or the rear portion of the frame 201 to rise or fall between a first level (FIG. 3) and a second level (FIG. 4), wherein a movement of the front portion of the guider and/or the rear portion of the frame causes an incline angle of the guider to vary between a first guider incline angle ($\theta_{G1}$) and a second guider incline angle ($\theta_{G2}$).

The above-mentioned operation can be reversible. The motor 2031 can drive the screw 2032 to rotate and to make the thread tube 2033 moving in the direction toward the motor 2031, and hence cause the frame 201 and the guider 202 back to the first position as shown in FIG. 3.

Figure 5:
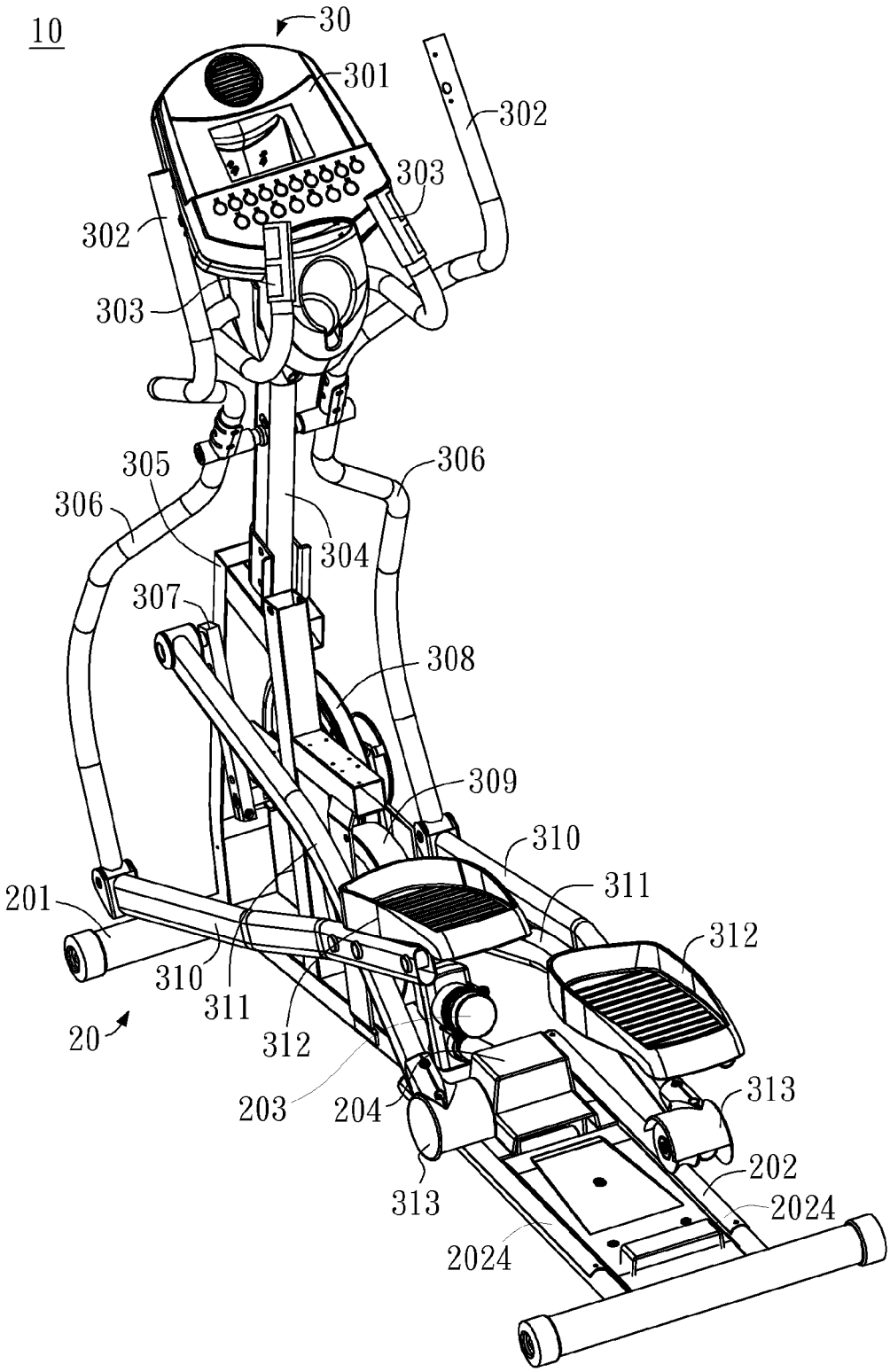

FIG. 5 shows more detail of the exercise device 10. The reciprocal-movement mechanism 30 may comprise, but is not limited to, a flywheel 309 providing a damping effect, a driving wheel 308 for driving the flywheel 309, two cranks 307 respectively arranged at a side of the driving wheel 308 for driving the driving wheel 308, two driving arms 311 with each arm comprising two ends, in which one end connects with one of the two cranks 307 and the other end having a wheel 313 coupled with the guider 202. In addition, two handle members 306 movably coupled to the angle-adjusting chassis 20, each of the two handle members 306 having at least one upper end 302 for enabling a user operating by hand. In particular, two handles 302 respectively connects with a swing arm 306, which connects with a linkage arm 310, and one end of the linkage arm 310 connects with a pedal 312. Further, the reciprocal-movement mechanism 30 may further comprise a bracket 305. A stationary stick 304 connects with the bracket 305, and a control panel and two stationary handles 303 connect with the stationary stick 304. The guider 202 comprises two guide rails 2024 enabling movements of two pedals 312 of the reciprocal-movement mechanism along the guide rails 2024, wherein a rear portion of each of the two pedals 312 is slidably coupled with a corresponding guide rail of the two guider rails 2024. Each of the two pedals 312 is pivotally or adjustably coupled with a corresponding linkage arm 310 of the two linkages arms 310.

The user steps on the pedals 312 with his or her hands holding the stationary handles 303 or the handles 302. Therefore, when the user exerts forces on the handles 302 and pedals 312, the flywheel 309 is driven by the driving wheel 308 via the swing arms 306, the linkage bars 310, the driving arms 311, and the cranks 307, and the wheel 313 reciprocates on the guider 202, and the pedals 312 makes an elliptical or an elliptical-like circle, respectively. The user can control the angle-adjusting assembly 203, e.g., motor, via the control panel 301, so as to control the first angle θ1 and the second angle θ2. The degree of the first angle θ1 and the second angle θ2 can be varied. For example, the slope of the frame 201 and the guider 202, can be slightly adjusted between the first angle θ1 and the second angle θ2, as respectively shown in FIGS. 3 and 4. In addition, the swing arm 306 and the handle 302 could slightly tilt when the frame 201 is raised. The reciprocal-movement mechanism 30 provides elliptical or elliptical-like moving paths between the first position and the second position and enables an operation by foot movements of the user.

It should be noted that the position of the intermediary part 204 affects the first angle θ1. The nearer the intermediary part 204 approaches to the rear end 202B, the smaller the first angle θ1 is, and vice versa. Similarly, the rear end 202B of the frame 201 is preferably the pivot point, and the nearer the pivot point approaches to the rear end 202B, the smaller the second angle θ2 is, and vice versa. In other embodiments of the present invention, the position of the intermediary part 204 and the pivot point can be other locations, so as to alter the first angle θ1 and the second angle θ2.

Figure 6:
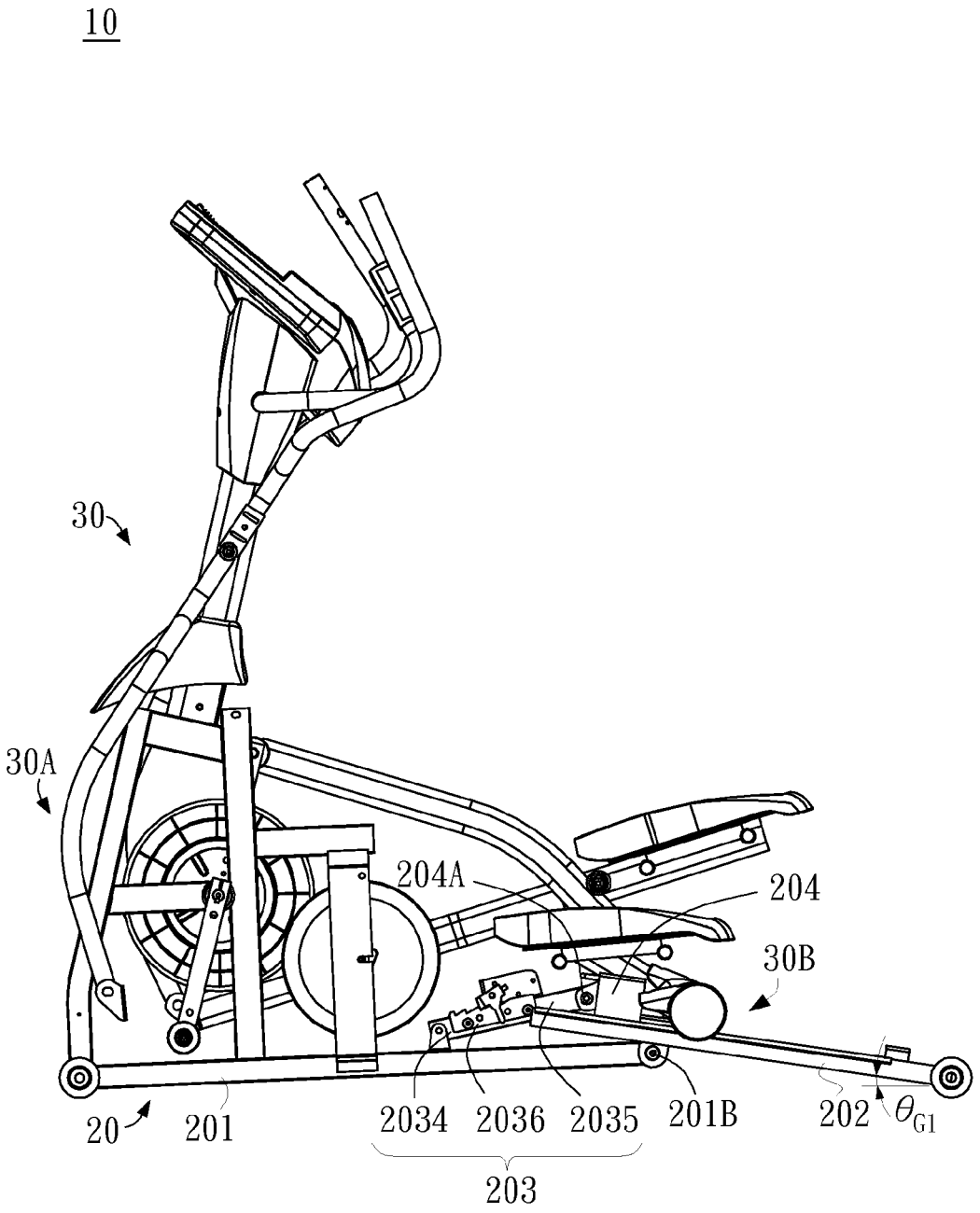
FIGS. 6, 7, and 8 are side and front views showing an exercise device according to a second embodiment of the present invention.
Figure 7:
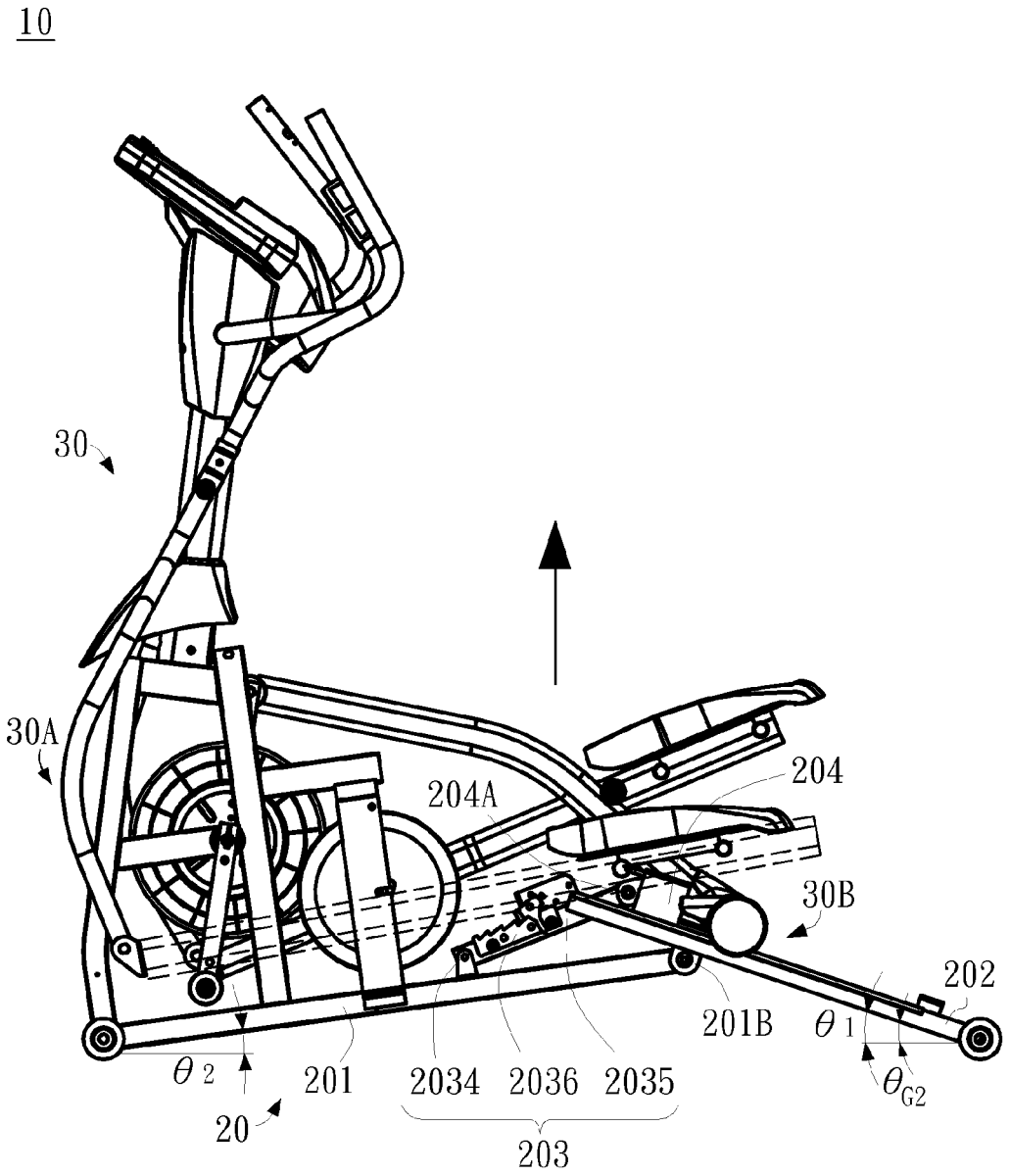
Figure 8:
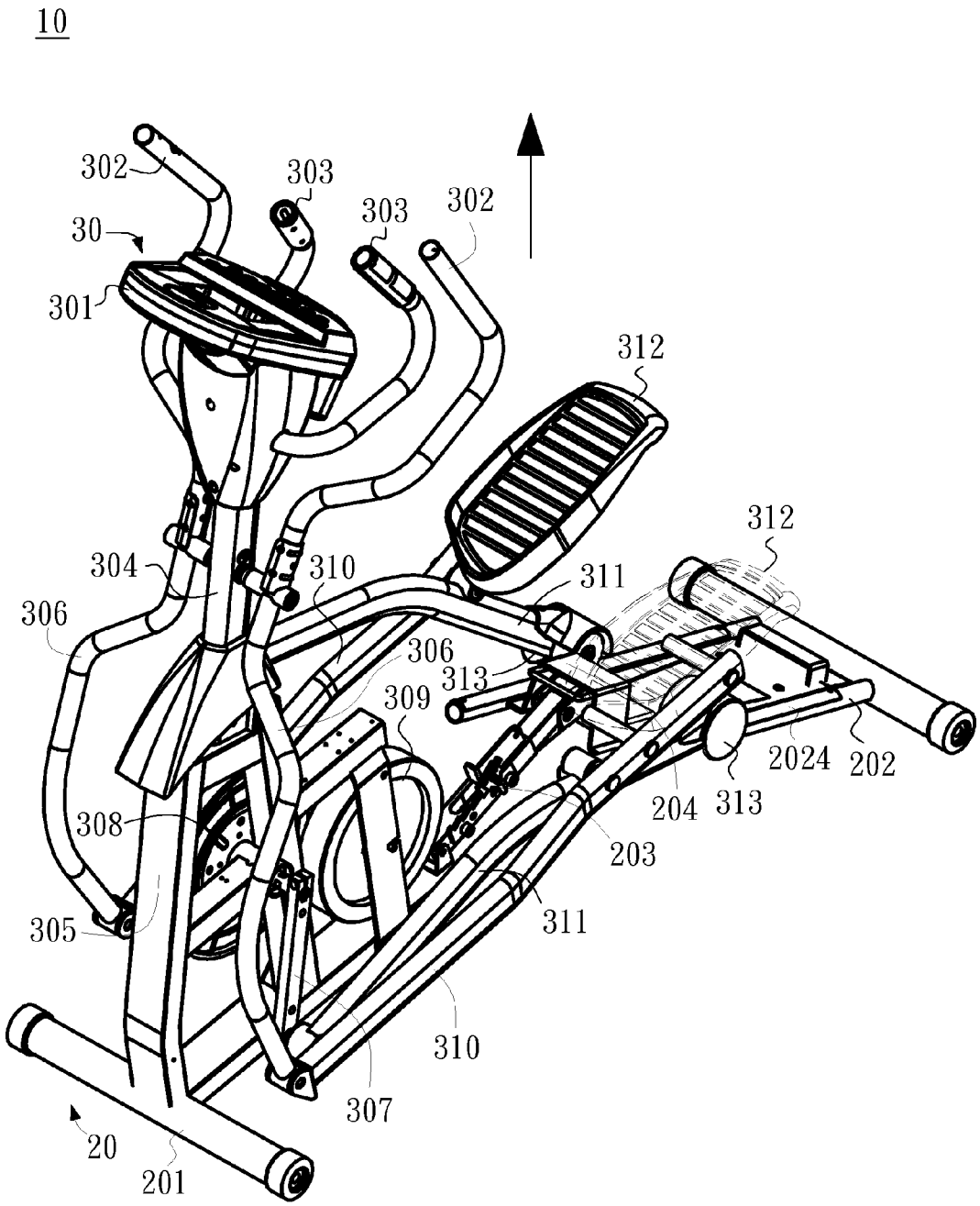

FIGS. 6-8 show an exercise device according to a second embodiment of the present invention. The difference between the first and second embodiment is the angle-adjusting assembly 203, and the other mechanisms are the same and hence omitted. In the second embodiment, the angle-adjusting assembly 203 is a manual assembly comprising an outer tube 2034, an inner tube 2035, and an engagement component 2036. The inner tube 2035 is arranged within the outer tube 2034. At least a hole of the inner tube 2035 is exposed to the sidewall of the outer tube 2034, and the engagement component 2036 is arranged on the hole. In addition, the inner tube 2035 pivotally connects with the intermediary part 204 via the pivot 204A. The detail of configuration and operation of the angle-adjusting assembly 203 of this embodiment can be found in an applicants' Taiwan Patent, publication no., M341527, the entire contents of which are incorporated herein by reference.

As shown in FIGS. 7-8, the user can drive the angle-adjusting chassis 20, manually or automatically via an automatic control device (not shown), to make the angle-adjusting chassis 20 moving in the direction of arrow as shown in FIGS. 7-8. As a result, the inner tube 2035 can be extended from the outer tube 2034 to push the intermediary part 204, the guider 202 can rotate about its rear end 202B, and the frame 202 can rotate about its front end 201A. And by adjusting the position of the blade of the engagement component 2036, the first angle θ1 and the second θ2 can be determined.

In addition, the inner tube 2034 can be retracted to the outer tube 2034 via the manual or automatic control device, so that the frame 201 and the guider 202 can restore to the position as shown in FIG. 6.

Figure 9:
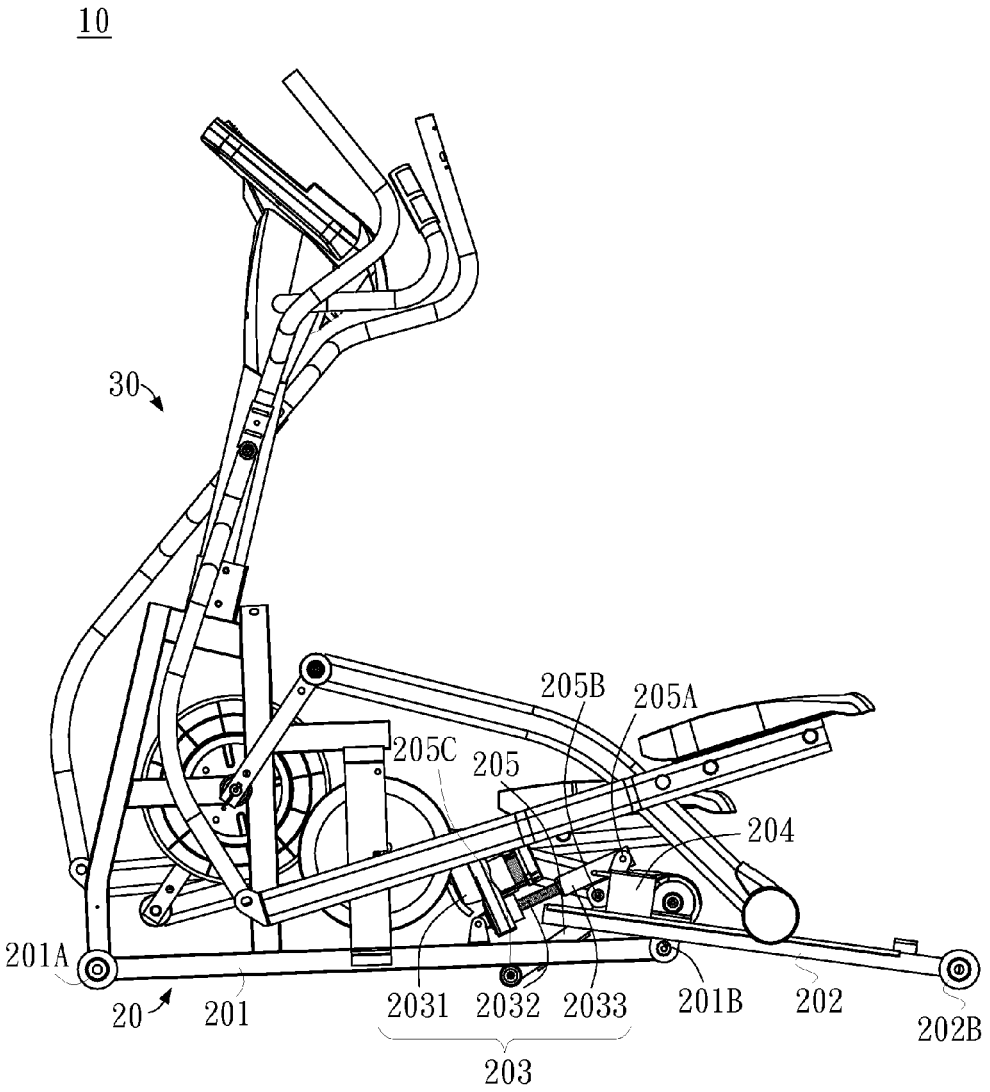
FIGS. 9, 10, and 11 are side and front views showing an exercise device according to a third embodiment of the present invention.
Figure 10:
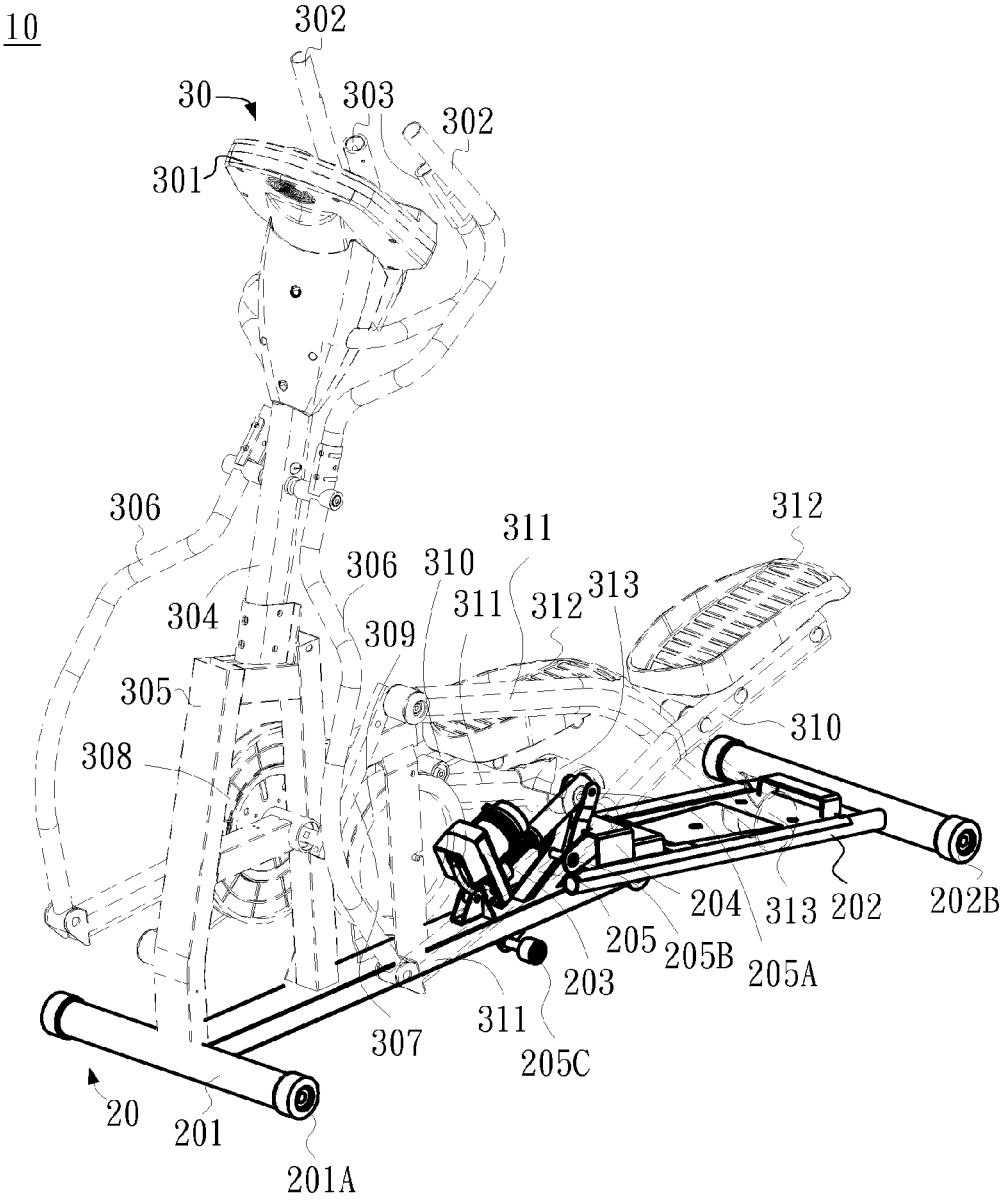
Figure 11:
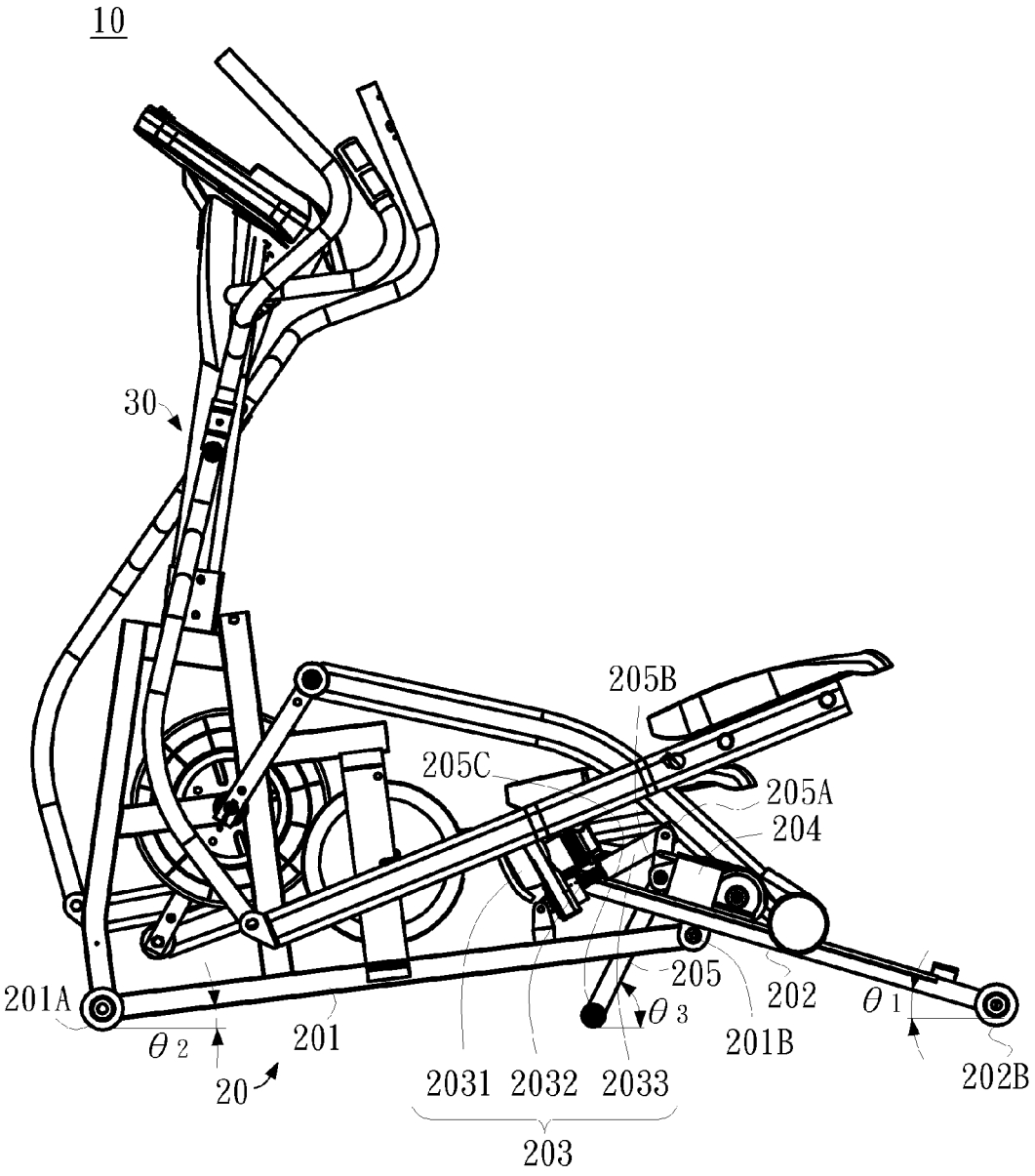

Referring to FIGS. 9, 10, and 11, an exercise device is disclosed according to a third embodiment of the present invention. In this embodiment, the angle-adjusting base 20 comprises a frame 201, a guider 202, an angle-adjusting assembly 203, an intermediary part 204, and a linkage assembly 205. The first embodiment is similar to the third embodiment, and the difference will be discussed as follows.

The linkage assembly 205 comprises an upper end 205A, a middle pivot 205B, and a lower end 205C. The intermediary part 204 is fixed with the guider 202, the upper end 205A pivotally connects with the thread tube 2033, the middle pivot 205B pivotally connects with intermediary part 204, and the lower end 205C is in contact with the supporting surface or the ground.

As shown in FIG. 11, the motor 2031 can drive the screw 2032 to rotate and to thus make the thread tube 2033 moving in the direction away from the motor 2031, so as to push the linkage assembly 205 to rotate around the middle pivot 205B, and the lower end 205C moves forward along the supporting surface or the ground. As a result, a third angle θ3 is present between the linkage assembly 205 and the supporting surface or the ground. In the meantime, the guider 202 rotates clockwise around its rear end 202B, and the frame 201 rotates counterclockwise around its front end 201A. As a result, a first θ1 is present between the guider 202 and the supporting surface (e.g., the ground), and a second angle θ2 is present between the frame 201 and the supporting surface. This embodiment provides better stability than others as using the additional fulcrum.

Figure 12:
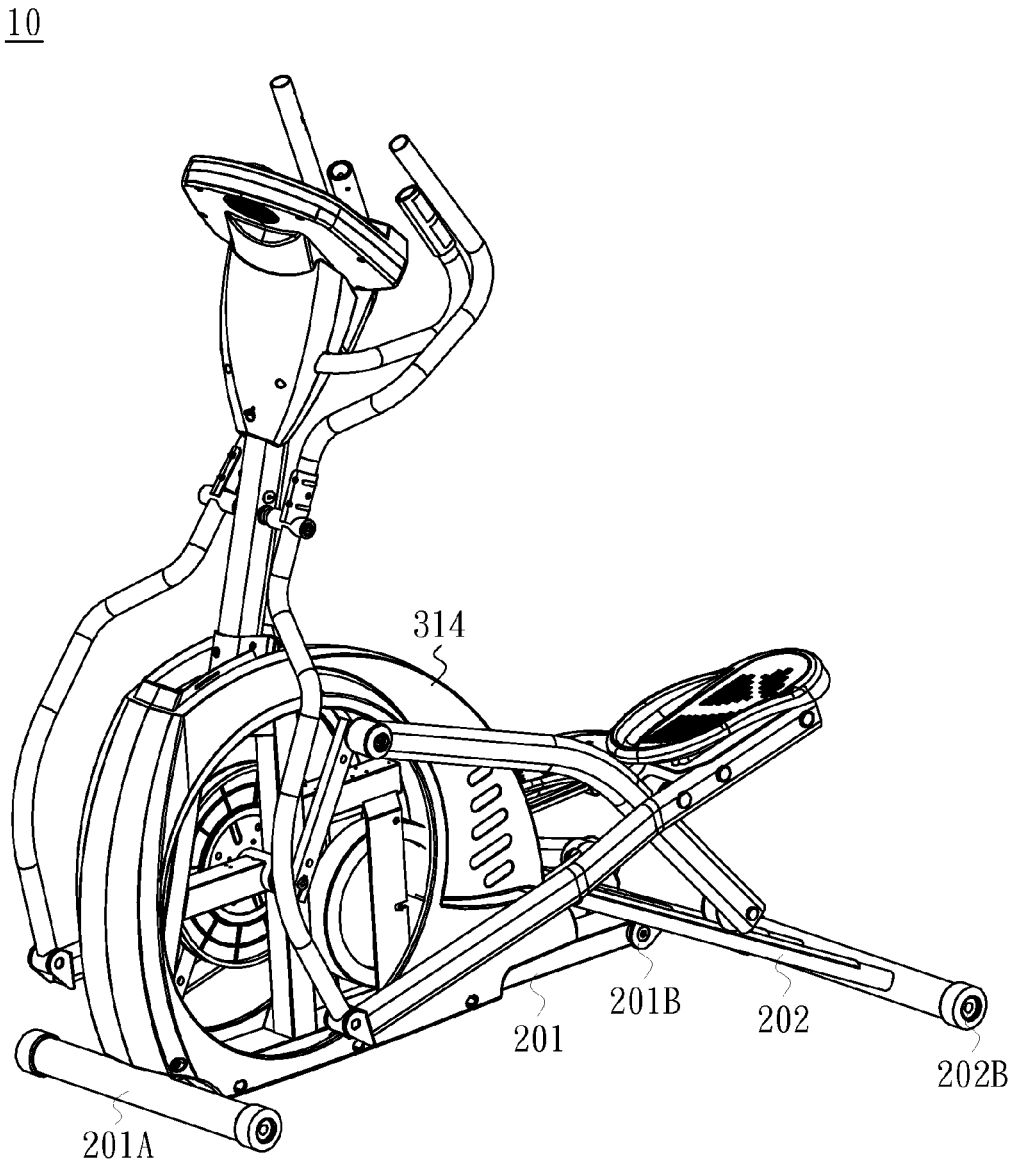
FIG. 12 is a front view showing a housing is applied in the exercise device of the foregoing embodiments of the present invention.

FIG. 12 shows that the exercise devices of this invention may further comprise a housing 314 disposed on the frame 201 to cover the driving wheel 308, the flywheel 309, and other components. The housing 314 can also be used in anyone of the foregoing embodiments.

Accordingly, embodiments of the present invention provide exercise devices in which the frame and the guider respectively rotate about an end, so as to alter and control a degree of the front portion of the frame relative to the supporting surface, i.e., θ1, and thus change the moving path of the reciprocal-movement mechanism. The frame and guider of conventional trainers are overlapped with each other. By contrast, the dimension of the frame is significantly reduced and the frame not overlaps with the guider; therefore the material cost can be saved. Further, the frame of conventional trainers needs to be horizontally arranged and attached to the ground, while the frame of the present invention has a novel design without those limitations. In addition, because the pivot point of the angle-adjustment chassis is near to the center of the elliptical trainer, the response time of the angle adjustment of this invention is faster than that of the prior art.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a reciprocal-movement mechanism operable between at least a first position and a second position, the reciprocal-movement mechanism has a front portion and a rear portion; and an angle-adjusting chassis coupled with the reciprocal-movement mechanism, the angle-adjusting chassis configured to change a moving path of the reciprocal-movement mechanism, the angle-adjusting chassis comprising:

a frame coupled with the front portion of the reciprocal-movement mechanism, the frame having a front portion configured to be directly supported by a supporting surface and a rear portion, the angle-adjusting chassis being configured to change the moving path of the reciprocal-movement mechanism by varying a degree of the front portion of the frame relative to the supporting surface;

a guider movably coupled with the rear portion of the reciprocal-movement mechanism, the guider having a front portion pivotably coupled with the rear portion of the frame, the guider having a rear portion directly supported by the supporting surface; and an angle-adjusting assembly coupled with the frame for driving an intermediary part that causes the rear portion of the frame to rise or fall between a first level and a second level, a movement of the rear portion of the frame causing an incline angle of the guider to vary between a first guider incline angle and a second guider incline angle.

2. The exercise device of claim 1, wherein the reciprocal-movement mechanism comprises a flywheel providing a damping effect, a driving wheel for driving the flywheel, two cranks respectively arranged at a side of the driving wheel for driving the driving wheel, two driving arms with each arm comprising two ends in which one end couples with one of the two cranks and the other end movably couples with the guider.

3. The exercise device of claim 2, wherein the reciprocal-movement mechanism further comprises:

two handle members movably coupled to the angle-adjusting chassis, each of the two handle members having at least one upper end for enabling a user operation by hand;

two linkage arms, each being coupled between a lower end of one of the two handle members and a portion one of the two driving arms; and two pedals coupled with the linkage arms.

4. The exercise device of claim 3, wherein each of the two pedals is pivotally or adjustably coupled with a corresponding linkage arm of the two linkage arms.

5. The exercise device of claim 1, wherein the reciprocal-movement mechanism provides an elliptical or elliptical-like moving path between the first position and the second position and enables an operation by foot movements.

6. The exercise device of claim 1, wherein the frame is pivotably movable relative to the supporting surface based on a pivot point near the front portion of the frame and near the supporting surface.

7. The exercise device of claim 1, wherein the guider is pivotably movable relative to the supporting surface based on a pivot point near the rear portion of the guider and near the supporting surface.

8. The exercise device of claim 1, wherein at least the front portion of the frame and the rear portion of the guider provide ground support for supporting the exercise device when the exercise device rests on the supporting surface.

9. The exercise device of claim 1, wherein the guider rotates clockwise around a pivot point near the rear portion of the guider to increase the incline angle when the frame rotates counterclockwise around a pivot point near the front portion of the frame, resulting in a first frame incline angle between a bottom of the frame and the supporting surface and the incline angle between the first guider incline angle and the second guider incline angle, with the incline angle being between a bottom of the guider and the supporting surface.

10. An exercise device, comprising:

a reciprocal-movement mechanism operable between at least a first position and a second position, the reciprocal-movement mechanism has a front portion and a rear portion; and an angle-adjusting chassis coupled with the reciprocal-movement mechanism, the angle-adjusting chassis configured to change at least one of a moving path of the reciprocal-movement mechanism, the first position, and the second position, the angle-adjusting chassis comprising:

a frame coupled with the front portion of the reciprocal-movement mechanism, the frame having a front portion configured to be directly supported by a supporting surface and a rear portion, the angle-adjusting chassis being configured to change the at least one moving path of the reciprocal-movement mechanism by varying a degree of the front portion of the frame relative to the supporting surface;

a guider movably coupled with the rear portion of the reciprocal-movement mechanism, the guider having a front portion pivotably coupled with the rear portion of the frame, the guider having a rear portion configured to be directly supported by the supporting surface; and an angle-adjusting assembly coupled with the frame for driving a movement of the front potion of the frame to vary the degree of the front portion of the frame relative to the supporting surface.

11. The exercise device of claim 10, wherein when the angle-adjusting assembly pushes to extend an intermediary part that is movably coupled between the front portion of the frame and the supporting surface, the guider rotates clockwise around the rear portion of the guider, and the frame rotates counterclockwise around the front portion of the frame, resulting in a variation of each of a first angle between the frame and the supporting surface and a second angle between the guider and the supporting surface.

12. The exercise device of claim 10, wherein the reciprocal-movement mechanism comprises a flywheel providing a damping effect, a driving wheel for driving the flywheel, two cranks respectively arranged at a side of the driving wheel for driving the driving wheel, two driving arms with each arm comprising two ends in which one end couples with one of the two cranks and the other end movably couples with the guider.

13. The exercise device of claim 12, wherein the reciprocal-movement mechanism further comprises:

two handle members movably coupled to the angle-adjusting chassis, each of the two handle members having at least one upper end for enabling a user operation by hand;

two linkage arms, each being coupled between a lower end of one of the two handle members and a portion one of the two driving arms; and two pedals coupled with the linkage arms.

14. The exercise device of claim 13, wherein each of the two pedals is pivotally or adjustably coupled with a corresponding linkage arm of the two linkage arms.

15. The exercise device of claim 10, wherein the angle-adjusting assembly comprises a motor, a screw, and a thread tube.

16. The exercise device of claim 10, wherein the angle-adjusting assembly comprises a threaded outer tube rotatably coupled with and wraps around at least a portion of a threaded inner tube therein.

17. The exercise device of claim 10, wherein a rear end of the frame pivotally connects with a front end of the guider.

18. The exercise device of claim 10, wherein a rear end of the frame is pivotally attached to and below the front portion of the guider.

19. The exercise device of claim 10, wherein the angle-adjusting assembly is attached to the rear portion of the frame.

20. The exercise device of claim 11, wherein the intermediary part is placed near and substantially under a front end of the guider.

21. An elliptical trainer, comprising:

a reciprocal-movement mechanism capable of being operated by a user; and an angle-adjusting chassis, comprising:

a frame, the reciprocal-movement mechanism being arranged on the frame, a front end of the frame directly contacting with a supporting surface;

a guider, a rear portion of the frame pivotally coupled with a front portion of the guider, a rear end of the guider directly contacting with the supporting surface;

an intermediary part coupled to the guider;

an angle-adjusting assembly coupled to the frame and the intermediary part; and a linkage assembly comprising an upper end, a middle pivot, and a lower end, wherein the upper end pivotally connects with the angle-adjusting assembly, the middle pivot pivotally connects with intermediary part, and the lower end is in contact with the supporting surface;

when the angle-adjusting assembly pushes the linkage assembly, the guider rotates clockwise around a pivot point near the rear end of the guider, and the frame rotates counterclockwise around a pivot point near the front portion of the frame, resulting in a variation in each of a first angle between the frame and the supporting surface, a second angle between the guider and the supporting surface, and a third angle between the linkage assembly and the supporting surface.

22. The elliptical trainer as set forth in claim 21, wherein the angle-adjusting assembly comprises a motor, a screw, and a thread tube.

23. The elliptical trainer as set forth in claim 21, wherein the angle-adjusting assembly comprises an outer tube, an inner tube, and an engagement component, and wherein the inner tube is arranged within the outer tube, at least a hole of the inner tube is exposed to a sidewall of the outer tube, and the engagement component is arranged on the hole.

24. The elliptical trainer as set forth in claim 21, wherein a rear end of the frame is pivotally connected with a front end of the guider.

25. The elliptical trainer as set forth in claim 21, wherein a rear end of the frame is pivotally attached to and below the front portion of the guider.

26. The elliptical trainer as set forth in claim 21, wherein the angle-adjusting assembly is attached to the rear portion of the frame.

27. The elliptical trainer as set forth in claim 21, wherein the intermediary part is arranged near the rear portion of the frame.

* * * * *